United States Patent [19]

Werner

[11] 4,425,673

[45] Jan. 17, 1984

[54] LIFTING SYSTEM FOR ADJUSTABLE HOSPITAL BED

[75] Inventor: Lester W. Werner, St. Louis, Mo.

[73] Assignee: B-W Health Products, Inc., Maryland Heights, Mo.

[21] Appl. No.: 211,544

[22] Filed: Dec. 1, 1980

[51] Int. Cl.[3] ..... A61G 7/00

[52] U.S. Cl. ..... 5/64; 5/63

[58] Field of Search ..... 5/63, 64, 66–69

[56] References Cited

U.S. PATENT DOCUMENTS

| | | | |
|---|---|---|---|
| 3,222,693 | 12/1965 | Pruim et al. | 5/62 X |
| 3,278,952 | 10/1966 | Holm | 5/66 X |
| 3,644,945 | 2/1972 | Goodman et al. | 5/63 |
| 3,802,002 | 4/1974 | Jones | 5/64 |
| 4,025,972 | 5/1977 | Adams et al. | 5/63 X |
| 4,094,024 | 6/1978 | Benoit et al. | 5/68 |
| 4,324,010 | 4/1982 | Houlberg et al. | 5/63 |

*Primary Examiner*—Alexander Grosz
*Assistant Examiner*—Michael F. Trettel
*Attorney, Agent, or Firm*—Gravely, Lieder & Woodruff

[57] ABSTRACT

Independently operable lifting mechanisms are provided at the head and foot ends of the fixed lower base frame of an adjustable hospital bed in order to facilitate independent height adjustment of the head and foot ends of the bed's movable upper frame. The two lifting mechanisms are actuated by respective ones of two drive screws which may be rotated individually or simultaneously and in either direction to position the upper frame at any desired height and at any selected tilt angle. In other words, by turning only one of the drive screws one end of the upper frame is elevated or lowered and the tilt angle will be changed. By rotating both of the drive screws at the same time the upper frame will be raised or lowered at a constant tilt angle. This flexibility enhances the medical treatment that a hospital patient may receive.

11 Claims, 10 Drawing Figures

10
10a
12
21
22
24
44
46
49
51
61
62
63
64
66
66a
67
67a
68
68a
69
69a
71
72
73
74
75
76
81
82
83
84
91
92
93
94
96
97
101
102
104
105
106
107
108
111
112
113
114
116
117
118
18a
18c
186

Fig. 5.
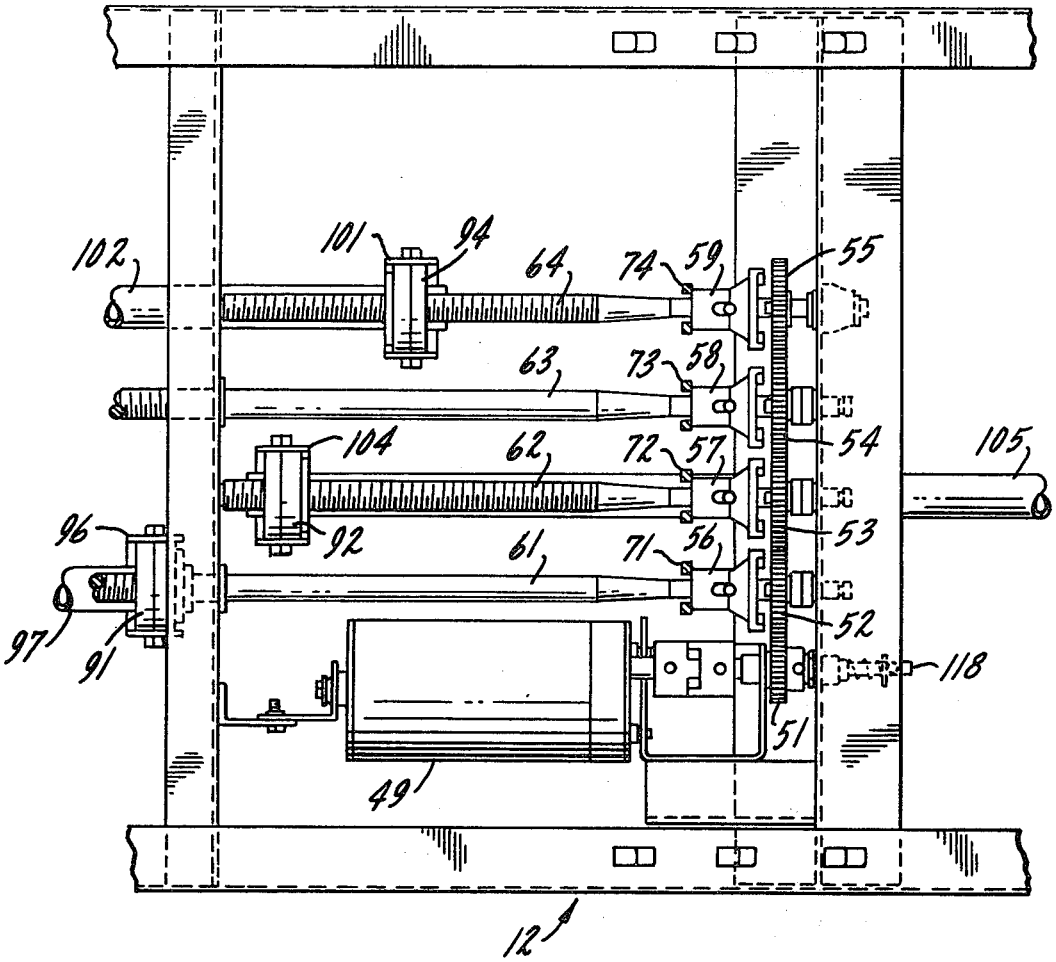
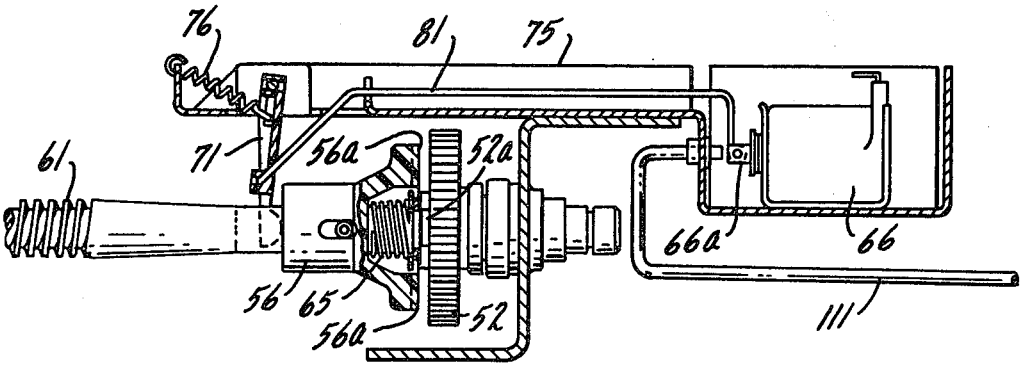
Fig. 6.

LIFTING SYSTEM FOR ADJUSTABLE HOSPITAL BED

BACKGROUND OF THE INVENTION

This invention relates to an adjustable hospital bed having a lifting system for elevating or lowering the bed in either a horizontal or a tilted position, while at the same time permitting independent height adjustment at each end.

Adjustable hospital beds are usually vertically movable so that the mattress supporting structure may be established at a selected desired height, within a range of permissible heights, from the floor. The lowermost level is most convenient when a patient is entering or leaving the bed. On the other hand, the uppermost height is generally preferred for examination and treatment of the patient. In addition, many adjustable hospital beds may be tilted or canted to either the trendelenburg position or to the reverse trendelenburg position. In the trendelenburg or shock position, the entire mattress supporting structure is tilted between 10° and 20° from horizontal so that the patient's head lies below his or her legs. In the reverse trendelenburg or drainage position the patient's head is above his or her legs.

To maximize the vertical adjustment range or travel in prior hospital beds, without sacrificing stability, the mattress supporting structure is customarily mounted on a movable upper frame which interconnects, via head and foot elevating linkage systems, to a fixed lower base frame located close to the floor. The elevating linkage systems are actuated to either lift or lower the upper frame, and consequently the mattress supporting structure, as desired. For trendelenburg or reverse trendelenburg positioning, the hospital bed usually must first be placed at a predetermined height and then actuated to the desired tilt position.

The hospital bed of the present invention is capable of assuming not only all of the various positions of the prior hospital beds but in addition a variety of other positions are obtainable. Moreover, this is achieved with a unique construction which is considerably simpler and more reliable than those of the previously developed hospital beds. A salient feature of the invention is the capability of actuating the bed to its trendelenburg or reverse trendelenburg position from any level. The bed may be tilted in either direction, and to any tilt angle, regardless of the height of the bed at the time. This feature, among other advantages, results in a significant time saving when adjusting the bed.

SUMMARY OF THE INVENTION

The adjustable hospital bed of the present invention comprises a stationary lower base frame and a movable upper frame, each of the frames having head and foot ends. A head lifting mechanism, mounted on the lower base frame at its head end, is provided for raising and lowering the head end of the upper frame. There is a foot lifting mechanism, mounted on the lower base frame at its foot end, for raising and lowering the foot end of the upper frame. Means, including a rotatable head drive screw, are included for operating the head lifting mechanism to adjust the height of the upper frame's head end. Means, including a foot drive screw which is independently rotatable relative to the head drive screw, operates the foot lifting mechanism to adjust the height of the upper frame's foot end. Finally, the adjustable hospital bed comprises means for rotating the drive screws individually or collectively and in either direction in order to position the upper frame at any selected desired height and at any selected desired tilt angle.

DESCRIPTION OF THE DRAWINGS

The features of the invention which are believed to be novel are set forth with particularity in the appended claims. The invention may best be understood, however, by reference to the following description in conjunction with the accompanying drawings in which like reference numbers identify like elements, and in which:

FIG. 5 is a fragmentary top view showing some of the parts hidden in the FIG. 3 view;

FIG. 6 is a fragmentary side view, partially in section, of some of the elements of FIGS. 3 and 5 on an expanded scale;

DESCRIPTION OF THE ILLUSTRATED EMBODIMENT

Figure 1:
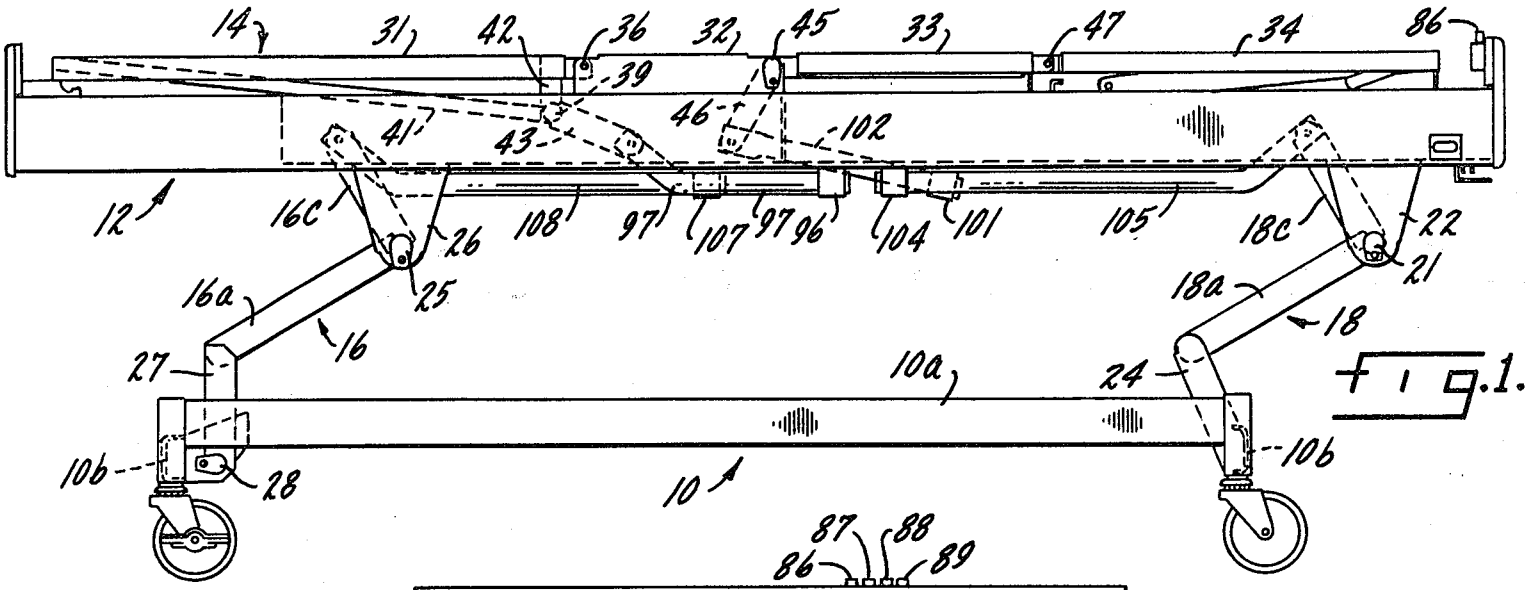
FIG. 1 is a side view of an adjustable hospital bed constructed in accordance with one emdodiment of the invention, the bed being illustrated with its two lifting mechanisms placing the bed in a normal horizontal position with the head end on the left and the foot end on the right.

The disclosed hospital bed includes a stationary or fixed lower base frame 10 (see particularly FIGS. 1 and 2), and a movable upper frame 12 on which is mounted an articulated mattress supporting structure 14. Frame 10 has a pair of longitudinal bars or rails **10*a* with a pair of transverse or cross bars 10*b* at the foot and head ends. Movable frame 12 is supported on and is vertically adjustable with respect to fixed frame 10 by means of head and foot lifting mechanisms or elevating linkage systems 16, 18, respectively, which together provide a parallelogram lifting system. It will be apparent, however, that the invention may be employed with other lifting systems, such as a trapezoidal system. Elevating linkage system 18 takes the form of a lift yoke having a pair of channel shaped long lever or lift arms 18*a* rigidly affixed to a pivot or torque tube 18*b* (see FIG. 2) which in turn is pivotally attached, by means of pivot studs 21, to a pair of brackets or lift support plates 22 rigidly secured to upper frame 12. The lift yoke also includes a pair of short lever arms 18*c* rigidly affixed to pivot tube 18*b*. The lower or free end of each lever arm 18*a* pivotally connects to a pair of brackets 24 rigidly affixed to the cross bar 10***b* at the foot end of base frame 10. It should be apparent that by moving the free or upper ends of short lever arms 18*c* to the right, as viewed in FIGS. 1 and 4, to effect clockwise rotation of yoke 18 around pivot studs 21, brackets 22 and consequently the foot end of upper frame 12 will be lowered. On the other hand, if lever arms 18*c* are moved to the left to rotate yoke 18 in a counterclockwise direction, brackets 22 and the foot end of frame 12 will be raised.

Although the drawings do not include an end view of the head end of the bed, it will be understood that head elevating linkage system 16 takes the form of a lift yoke of similar construction to yoke 18, having a pair of long lever arms 16*a* rigidly secured to a pivot or torque tube to which is also rigidly affixed a pair of short lever arms 16*c*. By means of a pair of pivot studs 25, the pivot tube is rotatable mounted to a pair of lift support plates or brackets 26 rigidly secured to frame 12. The lower or free ends of lever arms 16*a* are pivotally coupled to the upper ends of brackets 27, the lower ends of the brackets being pivotally attached to frame 10 by means of pivot studs 28. In similar fashion to the operation of yoke 18, when the upper ends of lever arms 16*c* are moved to the right (as viewed in FIG. 1) yoke 16 rotates clockwise around pivot studs 25 causing brackets 26 and the head end of upper frame 12 to descend. Conversely, when lever arms 16*c* are moved to the left counterclockwise rotation results and the head end of frame 12 moves upwardly. The lower ends of brackets 27 are pivotally coupled to base frame 10 by studs 28 to allow the bed to assume the various positions shown in FIGS. 7–10.

Figure 2:
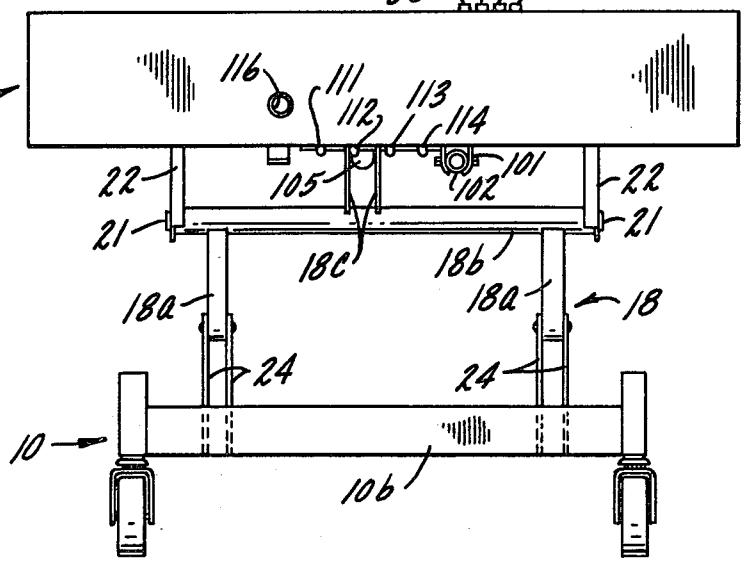
FIG. 2 is a view of the foot end of the bed of FIG. 1.

Articulated mattress supporting structure 14 is divided into four interconnected sections or panels, namely a back support section 31, a center or seat support section 32, an upper knee or thigh support section 33 and a lower knee or foot section 34. Each of the four support sections preferably takes the form of a perforated metal panel, but of course other constructions could be employed. For example, each mattress support section may constitute a bed spring. Seat support section 32 is rigidly affixed to frame 12, while one side or edge of back support section 31 is pivotally connected, by means of a pair of pivot studs 36 (only one of which is shown in FIG. 1), to seat support section 32. As will be described, adjusting means are provided for tilting back section 31 upward, with respect to fixed seat section 32, to raise the back and head of the patient occupying the bed to maximize comfort. The tilting is achieved by a torque or pivot tube 39 (see FIG. 1) secured to back section 31 by rigid structual members 41 and 42. A pair of lever arms 43 (only one of which is shown in FIG. 1) are rigidly affixed to tube 39 in order to facilitate turning of the tube. As the free ends of lever arms 43 are moved to the left, as viewed in FIG. 1, tube 39 rotates in a clockwise direction thereby tilting back support section 31 upward.

Figure 3:
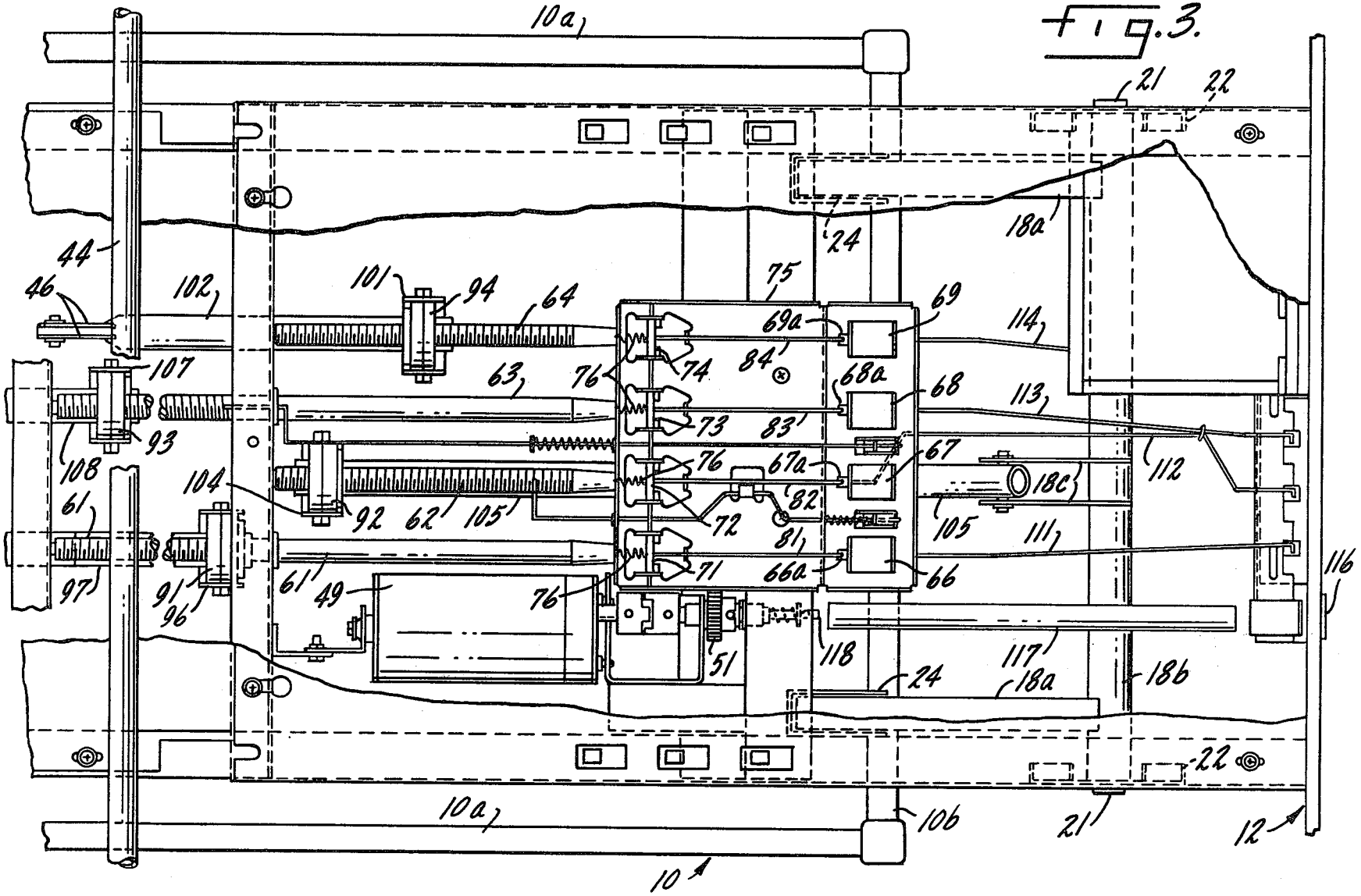
FIG. 3 is a fragmentary and partially broken away top or plan view of the bed of FIG. 1 on an expanded scale.
Figure 4:
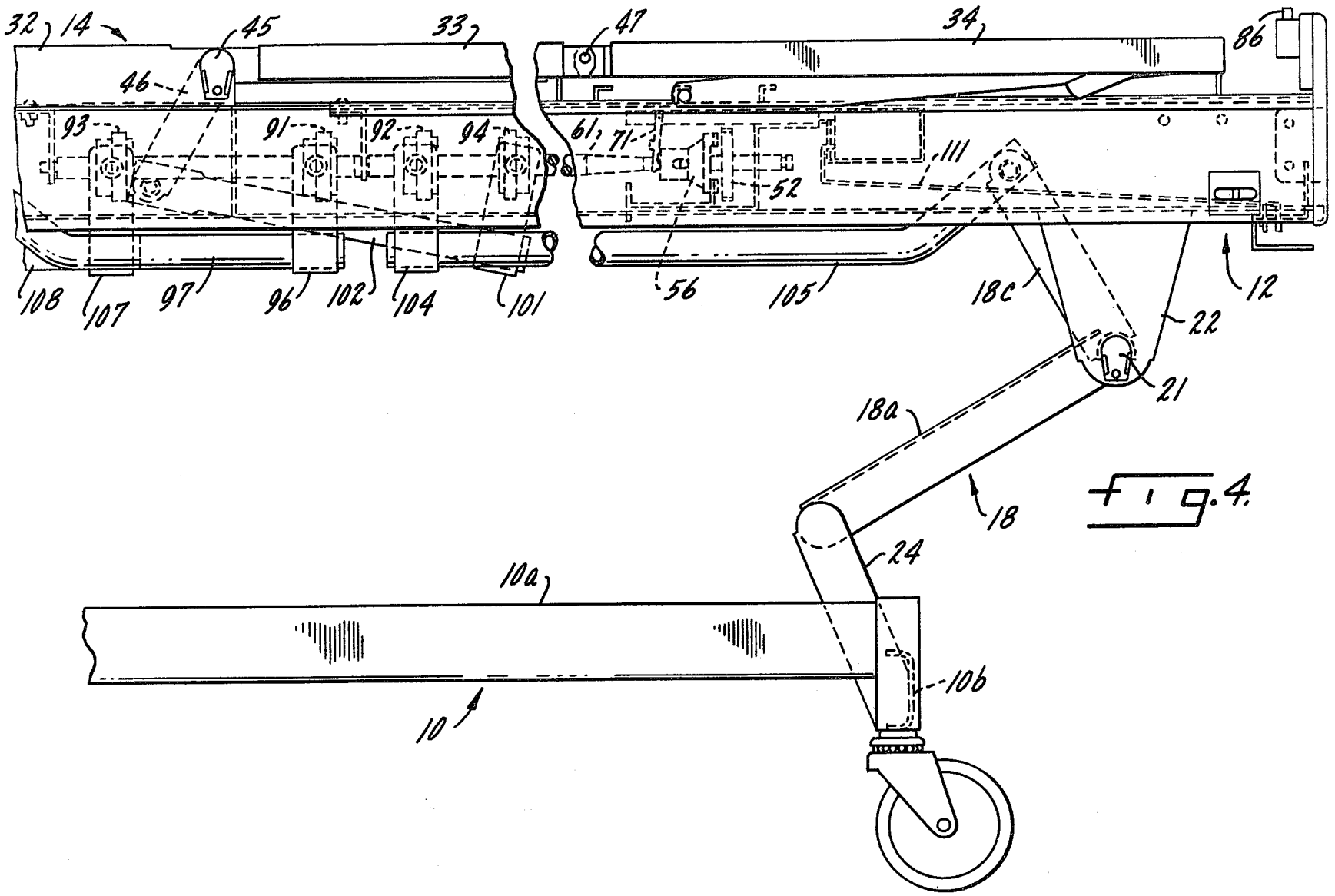
FIG. 4 is a fragmentary side view of the bed showing the side view of some of the parts illustrated in FIG. 3 and on the same scale as FIG. 3.

The adjacent sides of knee support sections 33 and 34 are pivotally interconnected by a pair of pivot studs 47, only one of which is shown in FIGS. 1 and 4. The left side of section 33 (as viewed in FIGS. 1 and 4) rigidly attaches to a torque or pivot tube 44 (see FIG. 3) which is rotatably mounted to seat support section 32 by pivot studs 45, only one of which is seen in FIGS. 1 and 4. A pair of lever arms 46 (see FIGS. 1, 3 and 4) are rigidly secured to torque tube 44 so that movement of the free ends of those arms toward the right (as viewed in FIGS. 1 and 4) results in counterclockwise pivoting of tube 44 around pivot studs 45. Upper knee support section 33 therefore tilts upward and since that section is pivotally connected to lower knee support section 34 by studs 47, the left side of section 34 will be raised. Sections 33 and 34 will thus form an inverted V in order to raise the patient's knees. Adjusting means will be described for pivoting lever arms 46 to effect a desired knee adjustment to maximize the patient's comfort.

The movable members 16, 18, 31, 33 and 34 may all be actuated, either individually or collectively, by a single reversible or bidirectional electric motor 49 (see FIGS. 3 and 5) supported on upper frame 12. When energized, motor 49 drives gear 51 which in turn rotates the four intercoupled driven gears 52–55. Each of the gears 52–55 couples, via a respective one of four clutches 56–59, to a respective one of four screw-threaded drive shafts or drive screws 61–64, screws 61, 62 and 64 having left-handed threads while screw 63 has right-handed threads. Clutches 56–59 are normally spring biased out of engagement with their respective gears 52–55. The gears and clutches have dogs or lugs which interlock when engaged in order that gear rotation will be transferred to the associated drive screw. Attention is directed particularly to FIG. 6 which illustrates, in greater detail, the construction of clutch 56 and the apparatus for controlling it. Of course, since all of the clutches 56–59 are of similar construction only one is shown in FIG. 6 and the explanation of its construction and operation applies to all of the other clutches. The spring biasing of clutch 56 is accomplished by coil spring 65 which pushes the clutch to the left and out of engagement with gear 52. Lugs 52*a* on gear 52 and lugs 56*a* on clutch 56 interlock when the clutch is moved to the right and into engagement with the gear. Each of clutches 56–59 is actuated into engagement with its associated gear by a respective one of four solenoids 66–69 (see FIG. 3) which actuate U-shaped yokes 71–74, respectively. Each of yokes 71–74 is pivotally connected to support pan 75 (mounted on frame 12) and straddles a respective one of drive screws 61–64 and abuts the screw's clutch. Coil springs 76 bias the free ends of yokes 71–74 so that minimal pressure is normally applied to the clutches by the yokes. Actuation of each yoke in response to energization of its associated solenoid is achieved by means of linkages or rods 81–84 each of which connects a respective one of yokes 71–74 to a respective one of movable cores 66*a*–69*a* of solenoids 66–69, respectively. This construction is clearly illustrated in FIG. 6.

When motor 49 is rotating, thereby rotating all of gears 52–55, and a selected solenoid is energized, the yoke associated with the solenoid will be pulled to the right, as viewed in the drawings, to actuate or move its clutch into engagement with its associated one of gears 52–55, thereupon causing rotation of the associated drive screw in response to the gear rotation. In short, any time motor 49 is energized, all of gears 52–55 will be rotating and by energizing a selected one or more of solenoids 66–69 a corresponding selected one or more of drive screws 61–64 will be rotated. Of course, the rotational directions of the drive screws will depend on the direction of motor 49, but since that motor is reversible it is possible to rotate each of screws 61–64 in either of its two directions. Any appropriate electrical circuitry may be employed to control the energization of motor 49 and of solenoids 66–69 to achieve the desired actuation of drive screws 61–64. A relatively simple circuit will achieve the necessary operation. The circuitry may be controlled by switches actuated by the four manually operated switch actuators 86–89 (see FIG. 2) mounted at the foot end of upper frame 12. In effect, each of switch actuators 86–89 may control the energization of a respective one of solenoids 66–69, while at the same time controlling the direction of motor 49. For example, each actuator may be a push button of the rocker type which may be depressed or rocked in one direction to energize the associated solenoid and to operate the motor in one direction, and which may be rocked in the other direction to energize the same solenoid but to operate the motor in its other direction. Preferably, the patient occupying the bed will have a remote control device for remotely controlling the circuitry for the motor and solenoids. Such a control device may either be held by the patient or removably attached to the bed.

The rotational motion of screws 61–64 is converted to linear motion by the four drive mechanisms 91–94, respectively, the movements of which cause adjustment of the bed. Each of these mechanisms includes an internally-threaded collar or clutch nut threadedly engaged on its associated drive screw. The collar or nut is held against rotation by friction imposed on it by a non-rotatable housing which surrounds the nut. The design of each nut and clutch joint is such that the total friction generated by the clutch joint will be greater than the friction generated between the drive screw threads interacting with the nut threads. Hence, as a drive screw rotates, its associated drive mechanism, namely its clutch nut and housing, will travel linearly and axially along the screw. Although not shown, pins may be provided on each drive screw to define the limits of travel of the associated drive mechanism, the pins rotating with the drive screw. When a drive mechanism travels along its drive screw to a limit of travel established by a pin, the clutch nut in the mechanism will engage the pin and its linear travel will be terminated even though the drive screw continues to rotate. The rotating pin rotates the nut within its housing, the nut thereby free wheeling, as the drive screw rotates. The nut housing, and consequently the drive mechanism, therefore remains axially stationary on the rotating drive screw. Thus, continued rotation of a drive screw after its drive mechanism has reached a limit of travel results in no axial movement of the drive mechanism. This feature precludes the need for electrical switches to de-energize the motor when the bed adjustments reach their extreme positions.

Drive mechanism 91 pivotally couples to a linkage or bracket 96 rigidly affixed to a tube 97 which in turn is pivotally connected to the free ends of lever arms 43. When drive screw 61 is rotated in the direction which causes drive mechanism 91 to move linearly to the left (as viewed in the drawings), arms 43 and torque tube 39 will be rotated in a clockwise direction and back support section 31 will be tilted upward. Opposite rotation of drive screw 61 will lower section 31 from its tilted position. Screw 61 may thus be referred to as the "back drive screw". In similar fashion, drive mechanism 94 pivotally connects to linkage or bracket 101 which is rigidly secured to one end of a tube 102. The other end is pivotally coupled to the free ends of lever arms 46 in order that rotation of drive screw 64 (which may be called the "knee drive screw") will rotate tube 44 to raise or lower the knee support sections 33 and 34.

Movement of drive mechanism 92 results in actuation of foot elevating linkage system 18 to raise or lower the foot end of upper frame 12, depending on the rotational direction of drive screw 62, referred to as the "foot drive screw". More specifically, the clutch nut housing of drive mechanism 92 is pivotally coupled to a bracket or linkage 104 which rigidly connects to one end of a thrust tube 105, the other end of which pivotally connects to lever arms 18*c*. When foot drive screw 62 is rotated in the direction to move drive mechanism 92, and consequently tube 105, to the right in the drawings, lever arms 18*c* will be rotated in a clockwise direction causing the foot end of frame 12 to descend. Conversely, opposite direction rotation of screw 62 results in counterclockwise rotation of yoke 18 and raising of the upper frame's foot end.

The head elevating linkage system 16 functions in similar manner to effect independent raising and lowering of the head end of frame 12. Drive mechanism 92 is pivotally coupled to linkage or bracket 107 which rigidly attaches to one end of a thrust tube 108, the other end being pivotally coupled to the free ends of lever arms 16*c*. When drive screw 63 (called the "head drive screw") rotates in the direction required to move drive mechanism 93 to the right, tube 108 will cause clockwise rotation of yoke 16 with resultant lowering of the head end of frame 12. On the other hand, opposite direction rotation of head drive screw 63 effects counterclockwise rotation of yoke 16 and raising of the frame's head end. Note that the lifting loads are divided between the two screw/nut combinations. Among other advantages, this reduces wear on the mechanical elements.

Figure 7:
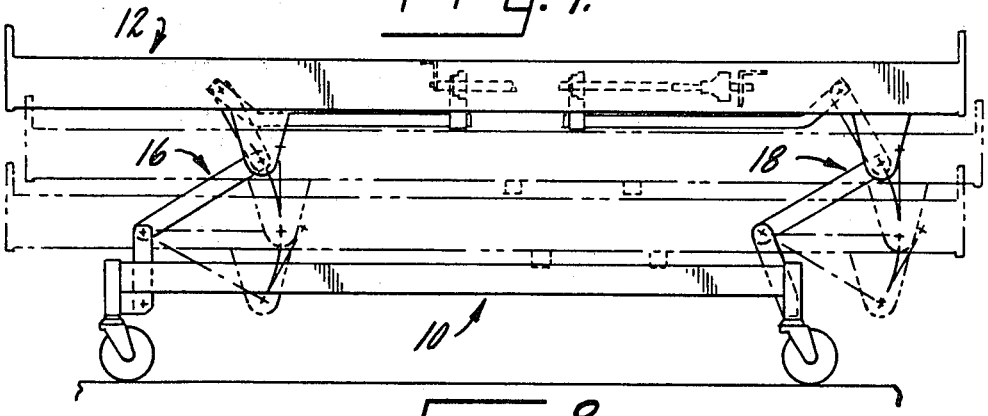
FIG. 7 illustrates the vertical movement of the bed when the upper frame is horizontal and when both the head and foot lifting mechanisms are actuated simultaneously.
Figure 8:
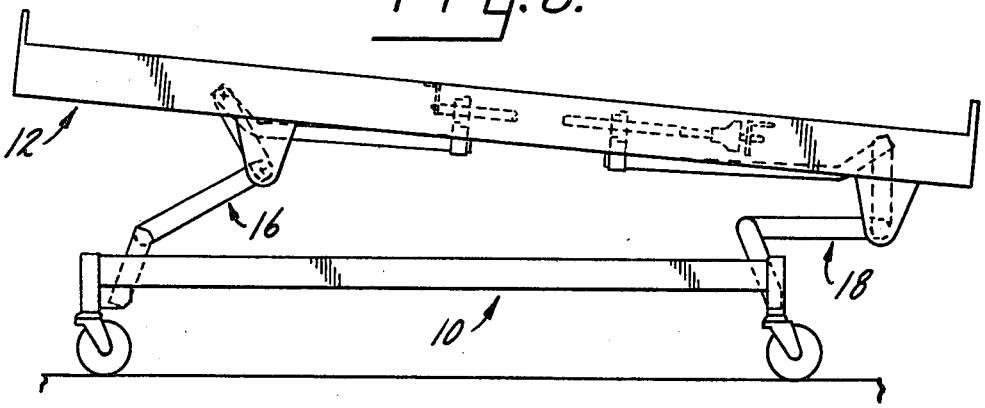
FIG. 8 depicts the manner in which the bed may be tilted to the reverse trendelenburg position when only the head lifting mechanism is operated.
Figure 9:
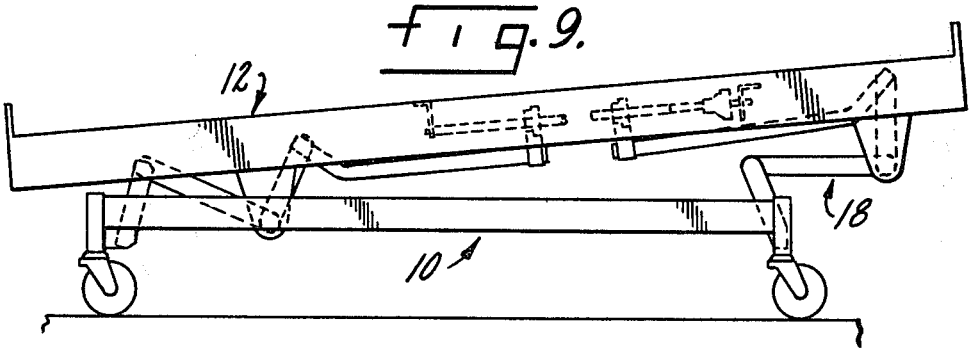
FIG. 9 shows the foot lifting mechanism in the same position as in FIG. 8, but the head lifting mechanism has been actuated so that the bed is tilted in the other direction to the trendelenburg position; and, FIG. 10 illustrates the manner in which the upper frame may be elevated or lowered while it is tilted.
Figure 10:
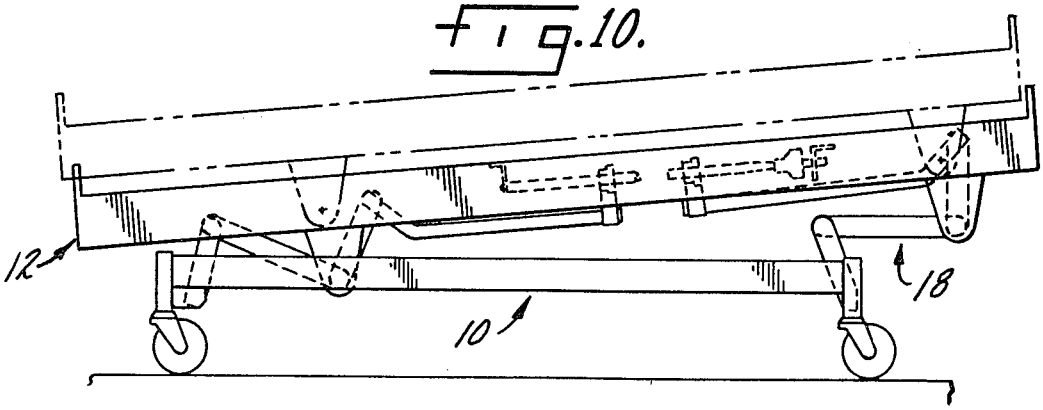

It will now be apparent that since each of lifting mechanisms 16 and 18 and its driving apparatus is entirely independent of the other lifting mechanism and its driving apparatus, the head and foot ends of upper frame 12 may each be positioned at any selected level or height, as a consequence of which frame 12 may be made horizontal or tilted and may be established at any desired level. This flexibility in operation is clearly illustrated in FIGS. 7–10. FIG. 7 depicts the operation of the bed when upper frame 12 is horizontal and both of drive screws 62 and 63 are rotating simultaneously or collectively, thereby elevating and lowering the frame in its horizontal position. When the foot drive screw 62 is not rotated but the head drive screw 63 is, the head end of frame 12 may be raised, as shown in FIG. 8, to establish the bed in the reverse trendelenburg position. FIG. 9 shows the action when the foot end of frame 12 remains at the same height as in FIG. 8 and the head drive screw 63 is rotated in the opposite direction to lower the upper frame's head end to place the bed in the trendelenburg position. FIG. 10 illustrates the operation when, starting from the tilted position of FIG. 9, drive screws 62 and 63 are rotated simultaneously, thereby elevating the entirety of frame 12 while it is tilted.

Hence, frame 12 can be tilted at any height and the height may be changed while at any tilt angle. Also the tilt angle may be changed by raising or lowering either end of frame 12 thus obtaining a desired tilt angle without changing the height of one end. Of course, the head and foot lifting mechanisms are independently operable even when the back support section 31 and the knee support sections 33 and 34 are tilted relative to seat section 32. Since the bed can be shifted immediately to the trendelenburg position, without first going to an extreme upper or lower horizontal position, considerable time can be saved, and time is usually of the essence when a patient goes into shock.

It will also be appreciated that the operational flexibility afforded by the present invention is of considerable value since the patient treatment supplied by associated equipment, drainage bags, traction equipment, etc., is affected by the bed height. In addition, the bed height affects the ability of the medical staff to treat the patient. Significantly improved mechanical treatment of a patient may thus be obtained with the hospital bed of the present invention.

Of course, by the proper selection of the thread directions of drive screws 61 and 64, back support section 31 and knee support sections 33 and 34 may be adjusted in a desired direction at the same time that upper frame 12 is moving in a given predetermined direction. For example, it may be desirable to lower all of sections 31, 33 and 34 to their horizontal positions (shown in FIG. 1) as frame 12 is simultaneously being raised. This would expedite the establishment of the bed in the preferred patient examination position. It is also apparent that by employing four separate bidirectional motors, each of which drives a respective one of screws 61–64, still greater flexibility of operation is obtained when two or more bed adjustments are to be made at the same time.

In the event of a power failure, thereby precluding the operation of motor 49 and solenoids 66–69, linkages in the form of relatively rigid wires or rods 111–114 are provided to allow the nurse or attendant to mechanically depress the cores of the solenoids from the foot end of the bed. This is clearly seen in FIG. 6. By pulling linkage 111 to the right in FIG. 6, core 66*a* of solenoid 66 is pushed to the right and into the solenoid winding in the same manner as if the solenoid had been energized electrically. Gears 52–55 may then be driven by inserting a hand crank (not shown) through opening 116, at the foot end of frame 12 (see FIGS. 2 and 3), and then through tube 117, mounted on frame 12, for engagement with shaft 118 which is coupled to driving gear 51. By hand cranking shaft 118 gear 51 may be rotated to in turn rotate gears 52–55 in the same manner as if motor 49 was rotating. Hence, by manipulating selected ones of linkages 111–114 and by hand cranking shaft 118 all of the bed adjustments may be made.

In this connection, it should be realized that the invention does not require an electrically-operated or motorized bed. The invention could obviously be incorporated in a hand cranked bed which always has to be cranked when an adjustment is desired. It should also be appreciated that the lifting mechanisms may take different forms. While a parallelogram lifting system is employed in the illustrated embodiment, other systems, such as a trapezoidal lifting system, could be used. In the illustrated parallelogram lift, the head and foot drive mechanisms travel in the same linear direction when the upper frame is being raised or lowered. With a trapezoidal lift, the two drive mechanisms would be moving in opposite directions when the upper frame is being elevated or lowered.

Certain features disclosed in the present application are described and claimed in the following concurrently filed copending patent applications Serial Nos. all of which are assigned to the present assignee.

While a particular embodiment of the invention has been shown and described, modifications may be made, and it is intended in the appended claims to cover all such modifications as may fall within the true spirit and scope of the invention.

I claim:

1. An adjustable hospital bed comprising:

a lower base frame having head and foot ends;

a movable upper frame having head and foot ends;

a head elevating linkage system interconnecting the head ends of said frames and operable to adjustably elevate the upper frame's head end;

a foot elevating linkage system interconnecting the foot ends of said frames and operable to adjustably elevate the upper frame's foot end;

independently rotatable head and foot drive screws mounted one to the side of the other on said upper frame for rotation about parallel axes that are fixed in position with respect to said upper frame;

head drive means threadedly coupled to, and responsive to rotation of, said head drive screw for actuating said head elevating linkage system, rotation in one direction causing the upper frame's head end to raise whereas rotation of said head drive screw in the other direction effects lowering of the upper frame's head end;

foot drive means threadedly coupled to, and responsive to rotation of, said foot drive screw for actuating said foot elevating linkage system, rotation in one direction causing the upper frame's foot end to raise while rotation of said foot drive screw in the other direction effects lowering of the upper frame's foot end;

first means for rotating said head drive screw in a selected one of its two directions, said first means including a first gear that is mounted on and is capable of rotating relative to the head drive screw, and a first clutch for engaging the first gear with the head drive screw, so that the head drive screw will rotate in the direction that the first gear turns;

second means for rotating said foot drive screw in a selected one of its two directions, said second means including a second gear that is mounted on and is capable of rotating relative to the foot drive screw and a second clutch for engaging the second gear with the foot drive screw, so that the foot drive screw will rotate in the direction that the second gear turns;

the first and second gears forming part of a gear train and the first and second clutches being operable independently of each other or jointly;

the direction of the threads on the head and foot screws and the arrangement of the gear train being such that when the head and foot screws rotate in unison, the upper frame will change elevation while maintaining substantially the same angle with respect to the base frame;

and means coupled with the gear train for rotating the first and second gears in either direction of rotation;

said elevating linkage systems thereby being operable independently of each other in order to facilitate positioning of said upper frame at any selected desired height and at any selected desired tilt angle and further being operable simultaneously such that the upper frame changes elevation while maintaining substantially the same angular disposition with respect to the base frame.

2. An adjustable hospital bed according to claim 1 wherein each of said elevating linkage systems includes a plurality of lifting arms pivotally connected to at least one of said frames.

3. An adjustable hospital bed according to claim 1 wherein said head elevating linkage system includes a head lift yoke pivotally connected to each of said frames, wherein said foot elevating linkage system includes a foot lift yoke pivotally connected to each of said frames, wherein said head drive means pivots said head lift yoke in response to rotation of said head drive screw, and wherein said foot drive means pivots said foot lift yoke in response to rotation of said foot drive screw.

4. An adjustable hospital bed according to claim 1 wherein said head drive means includes an internally-threaded collar through which said head drive screw extends, said collar being held against rotation and travelling axially along said head drive screw in response to rotation thereof, and wherein the axial movement of said collar actuates said head elevating linkage system to effect movement of the head end of said upper frame.

5. An adjustable hospital bed according to claim 1 wherein each of said drive screws extends generally parallel to the longitudinal axis of said upper frame; wherein each of said drive means includes a clutch nut threadedly engaged on its associated drive screw; wherein each of said drive means includes means for holding its clutch nut against rotation, while permitting axial movement along its associated drive screw in response to rotation of the drive screw; and wherein the axial travelling of each clutch nut actuates the associated elevating linkage system to adjust the height of the associated end of said upper frame.

6. An adjustable hospital bed according to claim 1 wherein said means coupled with the gear train includes an electric motor.

7. An adjustable hospital bed according to claim 1 wherein said means coupled with the gear train requires hand cranking power to effect screw rotation.

8. An adjustable hospital bed according to claim 1 and including an articulated mattress supporting structure mounted on said movable upper frame and having, from its head end to its food end, a back support section, a seat support section, an upper knee support section and a lower knee support section, the four support sections being interconnected; including back adjusting means, mounted on said upper frame, for tilting said back support section with respect to said seat support section so that the back and head of the patient, occupying the hospital bed, may be raised or lowered; and further including knee adjusting means, mounted on said upper frame, for raising or lowering said upper and lower knee support sections where they join together in order to vary the position of the patient's knees.

9. An adjustable hospital bed according to claim 8 wherein said back adjusting means includes a back drive screw extending generally parallel to the axis of said upper frame, means for rotating said back drive screw in a selected one of its two directions, a back clutch nut threadedly engaged on said back drive screw, means for holding said back clutch nut against rotation while permitting axial movement along said back drive screw in response to rotation of said back drive screw, and means responsive to the axial travelling of said back clutch nut for adjusting the position of said back support section relative to said seat support section.

10. An adjustable bed comprising: a base frame; a movable frame located above the base frame and having a head end and a foot end; first and second torque members mounted upon and extended across the movable frame near the head and foot ends, respectively, thereof, with each torque member being capable of rotating relative to the movable frame; lower lever arms attached rigidly to the torque members and extended therefrom to the base frame to which they are pivotally connected, all such that the elevation of the movable frame may be altered by turning the torque members; at least one upper lever arm attached to each torque member and extended generally upwardly therefrom; first and second drive screws mounted on the movable frame parallel to each other and to the longitudinal axis of the frame, the two drive screws being located one to the side of the other and being rotatable relative to the upper frame about axes that are fixed in position with respect to the movable frame; a separate nut engaged with each of the first and second drive screws and adapted to move along its screw as the screw rotates; a first thrust member connected between the nut of the first drive screw and the upper lever arm of the first torque member; a second thrust member connected between the nut of the second drive screw and the upper arm of the second torque member; first and second gears mounted on the first and second drive screws, respectively, and being capable of rotating relative to their drive screws, the gears forming part of a gear train in which the first and second gears rotate in unison; drive means coupled with the gear train for rotating the first and second gears in either direction of rotation; and clutch means for engaging either the first or second gears with the first and second drive screws independently of each other, whereby the head and foot ends of the movable frame may be lowered or raised independently of each other, and for also jointly engaging the first and second gears with their respective drive screws such that the first and second drive screws rotate simultaneously, the direction of the threads on the first and second drive screws and the arrangement of the gear train being such that, when the drive screws rotate simultaneously, the upper frame changes elevation while maintaining substantially the same angular disposition with respect to the base frame.

11. A bed according to claim 10 and further comprising; a back section mounted on the movable frame such that it pivots about an axis extended transversely with respect to the movable frame; a knee section mounted on the movable frame such that it pivots about another axis that extends transversely with respect to the movable frame; third and fourth drive screws mounted on the movable frame parallel to and generally to the sides of the first and second drive screws; a separate nut engaged with each of the third and fourth drive screws and adapted to move along its drive screw as the drive screw rotates; a linkage mechanism connecting the nut of the third drive screw with the back section such that the back section pivots upwardly when the nut moves in one direction along the third drive screw and pivots downwardly when the nut moves in the opposite direction along the third drive screw; another linkage mechanism connecting the nut of the fourth drive screw with the knee section such that the knee section pivots upwardly when the nut moves in one direction along the fourth drive screw and pivots downwardly when the nut moves in the opposite direction along the fourth drive screw; third and fourth gears mounted on the third and fourth drive screws, respectively, and being capable of rotating relative to their drive screws, the third and fourth gears likewise forming part of the gear train so that they rotate with the first and second gears; and additional clutch means for engaging the third and fourth gears with the third and fourth drive screws independently of the clutch means for the first and second gears so, that the third and fourth drive screws are capable of rotating independently of the first and second drive screws.

* * * * *